United States Patent [19]

O'Connell et al.

[11] Patent Number: 4,916,927

[45] Date of Patent: Apr. 17, 1990

[54] LOCK AND METHOD OF SECURING AND RELEASING A MEMBER

[76] Inventors: John O'Connell, 12 Honeybourne Road, Halesowen, West Midlands B63 3EN; Roy S. Jefferies, Wilcot Cottage, 64 Linley Brook; Hugh Trevor-Jones, 82 Cartway, both of Bridgnorth, Shropshire, all of United Kingdom

[21] Appl. No.: 273,802

[22] Filed: Nov. 21, 1988

Related U.S. Application Data

[62] Division of Ser. No. 75,748, Jun. 25, 1987, Pat. No. 4,854,146.

[30] Foreign Application Priority Data

Oct. 25, 1985 [GB] United Kingdom ..... 8526395
Apr. 22, 1986 [GB] United Kingdom ..... 8609785

[51] Int. Cl.[4] ..... E05B 47/00
[52] U.S. Cl. ..... 70/276; 70/277
[58] Field of Search ..... 70/277, 278, 279, 271, 70/276, 280, 281, 282, 283, 494

[56] References Cited

U.S. PATENT DOCUMENTS

| | | | |
|---|---|---|---|
| 3,499,303 | 3/1970 | Spain | 76/494 |
| 3,670,538 | 6/1972 | Curry | 70/271 |
| 3,889,501 | 6/1975 | Fort | 70/283 |
| 4,068,507 | 1/1978 | Peterson | 70/271 |
| 4,177,257 | 12/1979 | Aydin | 70/278 |
| 4,603,564 | 8/1986 | Kleinhany | 70/277 |
| 4,712,398 | 12/1987 | Clarkson | 70/276 |

*Primary Examiner*—Robert L. Wolfe
*Attorney, Agent, or Firm*—Marshall, O'Toole, Gerstein, Murray & Bicknell

[57] ABSTRACT

Relative movement of members (10,11) of a lock is normally obstructed by an element (14) which can be moved by a solenoid (18) entirely into a recess in one of the members so that the one (11) and the obstructing element (14) can turn together relative to the other member (10) and solenoid. The arrangement may be used to prevent turning of a key-receiving member relative to a housing or as a clutch between two members mounted rotatably in a housing.

1 Claim, 4 Drawing Sheets

LOCK AND METHOD OF SECURING AND RELEASING A MEMBER

This application is divided from application Ser. No. 075,748 filed June 25th 1987 and now U.S. Pat. No. 4,854,146.

BACKGROUND TO THE INVENTION

In GB No. 2,158,867A, there is disclosed a lock having means for reading a key, for verifying data read from the key and releasing a key-receiving cylinder of the lock for rotation upon verification of the data. A cam is secured on the cylinder and the disc may be used for driving a bolt or other member which is to be controlled by the lock. A lever is pivoted in a housing of the lock and is spring-loaded to a position in which the lever obstructs turning of the cam and therefore of the lock cylinder. For pivoting the lever to a releasing position, there is provided a solenoid having an armature which is arranged to act on the lever and pivot the lever against the action of its spring. When the data read from the key has been verified, the solenoid is energised, thereby releasing the cylinder for turning by means of the key.

The arrangement described in GB No. 2,158,867A is satisfactory, in a case where electrical energy for energisation of the solenoid is derived from a mains supply. However, the prior arrangement is less satisfactory in cases where the lock is to be energised from a battery of cells. If the battery is small, the life of the battery will be relatively short. In order to achieve a long battery life, it would be necessary to provide a battery with a large capacity.

SUMMARY OF THE INVENTION

According to a first aspect of the invention, there is provided a method of securing, releasing, driving and re-securing in a predetermined position a member comprising the steps of providing securing means for releasably securing the member against movement from the predetermined position, providing an electrically energisable device for setting the securing means in a releasing position, reading data from a key, verifying the data, initiating electrical energisation of said device to set the securing means in the releasing position, terminating electrical energisation of said device, continuing to maintain the securing means in the releasing position, moving the member from said predetermined position, returning the member to said predetermined position and then moving the securing means to a securing position to secure the member once more in the predetermined position.

In a method in accordance with the first aspect of the invention, the securing means is maintained in the releasing position without continued energisation of the electrically energisable device used to set the securing means in the releasing position. Accordingly, only a current pulse of brief duration is required to be applied to the device and the source of electrical power is conserved.

The invention also provides a lock for use in a method according to the first aspect, the lock having an electrically energisable device for setting the obstructing element in a predetermined position, the device including means for retaining the obstructing element, after energisation of the device has been terminated, in that position.

Figure 1:
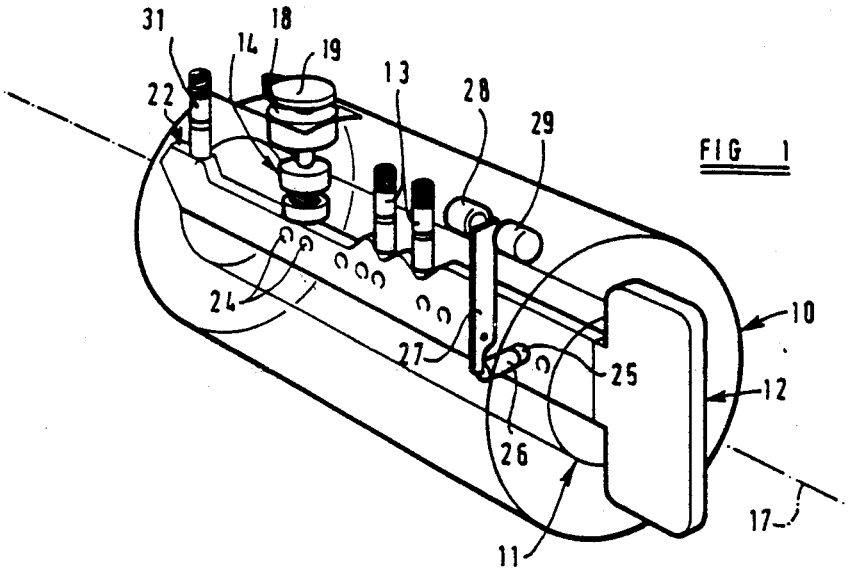
FIG. 1 is a diagrammatic representation of a perspective view of a lock and key.

The lock illustrated in FIGS. 1 to 4 of the drawings comprises a hollow housing 10 which would normally be fixed with respect to a supporting structure (not shown) in use. A key-receiving member 11 is mounted in the housing 10 for movement relative thereto when the proper key 12 is present in a slot defined by the member 11. The lock may incorporate tumblers 13 for restraining movement of the member 11 relative to the housing, when the key is absent. These tumblers may be arranged in a known manner, the key 12 being adapted to engage the tumblers when the key is introduced into the key-receiving member, and to move each tumbler to a respective releasing position, as is well known. Alternatively, the tumblers 13 may be omitted.

The lock comprises additional locking means for restraining or limiting movement of the member 11 relative to the housing, in the absence of the key. The additional locking means includes a locking element 14 which, in the example illustrated, is of cylindrical form. The additional locking means further comprises a transmitting element 15 and biasing means in the form of a spring 16. The spring is interposed between the elements 14 and 15 and urges these elements apart. As shown in the drawing, at least one of the elements 14 and 15 may be formed as a cup, with the spring at least partly received inside the element.

The key-receiving member 11 of the particular lock illustrated is arranged for rotation relative to the housing 10 when the proper key has been introduced into the member 11. The axis of relative rotation is indicated in FIG. 1 by the reference numeral 17. It will be understood that alternative arrangements may be used, for example arrangements providing for relative reciprocation of the key-receiving member and housing.

The locking element 14 is mounted in an opening at an external surface of the member 11 and is guided by the boundary of that opening for reciprocation relative to the housing 10 and member 11 along a path which is perpendicular to the axis 17. There is mounted in the housing 10, adjacent to the locking element 14, an electrically energisable motor in the form of a solenoid 18 having an armature 19 also guided for reciprocation in a direction perpendicular to to the axis 17. The solenoid has an output element 20 which may be fixed to the armature 19 and which bears against a flat surface of a locking element 14. The output element is preferably formed of non-magnetic material and may be sliding fit in a hollow core of the solenoid. In the example illustrated, the armature is adjacent to one end of the winding of the solenoid and never enters the core of the solenoid. Alternatively, the armature may include a portion having a sufficiently small diameter to penetrate into the hollow core of the solenoid, in which case the output element 20 would constitute a tip on one end of the armature.

The transmitting element 15 is mounted in the key-receiving member 11 normally to protrude into the key-slot from the opening containing the locking element 14. The transmitting element and key-receiving member are provided with mutually co-operating abutments (not shown) which limit approach of the element 15 towards the axis 17.

Movement of the armature 19 and output element 20 in a direction towards the axis 17 is limited by engagement of the armature with an end face of the solenoid. Movement of the armature and output element in the opposite direction is limited by a housing provided to enclose the solenoid and armature.

Figure 2:
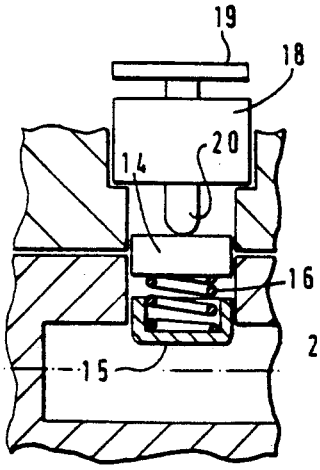
FIGS. 2, 3 and 4 illustrate certain parts of the lock and key of FIG. 1 during successive stages of operations.

When the key is absent, the locking element 14 occupies the position illustrated in FIG. 2, in which approximately one half of the locking element is disposed in the opening defined by the key-receiving member 11 and the other half of the locking element protrudes into a corresponding opening in the housing 10. Movement of the locking element from the locking position in a direction away from the axis 17 is prevented by the solenoid and armature 19. Whilst the key is absent, the locking element is retained in the locking position by the action of the spring 16.

As also shown in FIG. 2, when the key is absent the transmitting element 15 is spaced substantially from the locking element 14 and protrudes into the key-slot. The key 12 has on its leading end a chamfer 21 which, upon insertion of the key into the member 11, engages the transmitting element and drives the transmitting element away from the axis 17 until it no longer protrudes into the key-slot. A leading end portion 22 of the key can then move past the transmitting element into the position illustrated in FIG. 3. Whilst the locking element is in its locking position, that element does not obstruct movement of the transmitting element 15 in a direction away from the axis 17 sufficiently to leave the key-slot, although such movement does compress the spring 16.

Figure 3:
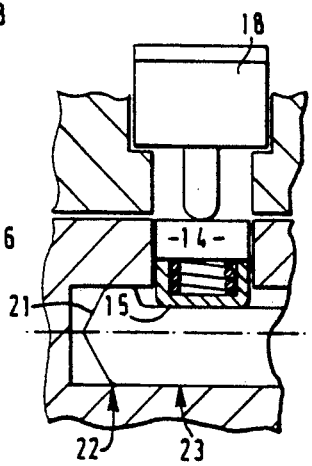

As illustrated in FIG. 3, an intermediate portion 23 of the key which is immediately adjacent to the transmitting element 15, when the key has been fully inserted, has a width substantially less than the width of the end portion 22 and presents towards the transmitting element a surface which is nearer to the axis 17 than is the corresponding surface presented by the end portion. Once the end portion has moved past the transmitting element, the latter is free to move towards the axis 17 to the position illustrated in FIGS. 2 and 3. In this position, the transmitting element is effective to retain the key in the key-slot by obstructing movement of the end portion 22 past the transmitting element.

The key bears information identifying the key and represented by openings 24 or other formations arranged in a row extending along the key. Reading means is provided for reading information from the openings 24 during insertion of the key into the member 11. The reading means includes a spherical contact element 25 mounted in the member 11 for reciprocation towards and away from the key-slot and arranged to protrude into the keyslot, in the absence of the key. The reading means further comprises a pin 26 also mounted in the member 11 for reciprocation with the contact element, a spring-loaded lever 27 pivotally mounted in the housing 10, a light-emitter 28 and a light-detector 29 both mounted in fixed positions within the housing 10. One end portion of the lever 27 can move into a position between the emitter 28 and detector 29 to interrupt the transmission of radiation through an aperture in a wall therebetween. During insertion of the key, the follower 25 moves into and out of successive openings 24, causing reciprocation of the pin 26 and rocking of the lever 27 which amplifies the motion and intermittently interrupts the transmission. The detector provides an electrical signal representing the information borne by the key and this signal is applied to an electronic processor 32.

The processor 32 compares information read from the key with information stored in a memory of the processor and, if a appropriate, provides an output signal which causes energisation of the solenoid 18. When the solenoid is energised, the armature 19 is caused to move towards the axis 17 to the position illustrated in FIG. 3. In so moving, the armature moves the locking element 14 to the releasing position, also illustrated in FIG. 3, in which the locking element is contained entirely within the key-receiving member 11. In this position, the locking element no longer obstructs movement of the member 11 relative to the housing 10. Provided the tumblers 13, if present, have been moved by the key to their releasing positions, the member 11 can then be turned about the axis 17 relative to the housing. Such turning causes the locking element 14 to slide on the tip 20 of the armature in a direction around the axis 17, until the locking element is clear of the armature tip and bears against an internal surface of the housing 10. Contact between this internal surface and the locking element maintains the locking element in the releasing position illustrated in FIG. 3.

When the locking element 14 is in the locking position, the armature 19 of the solenoid is spaced from the winding of the solenoid. There is associated with that winding a pole piece 33 of magnetic material which is engaged by the armature, when the solenoid is energised and the locking element is moved to the releasing position. Residual magnetism in the armature and the pole piece maintain the armature in the position illustrated in FIG. 3, without continued energisation of the solenoid. Thus, the output element 20 is effectively matched by magnetic forces in the releasing position. It will be understood that it is necessary to energise the solenoid for only a brief period, for example a few milliseconds. This conserves the source of electrical power, as compared with energisation of the solenoid until the key has been turned to move the locking element 14 out of alignment with the recess in the housing 10.

It will be noted that, whilst the locking element is maintained in the releasing position shown in FIG. 3, it maintains the transmitting element 15 also in the positios illustrated in FIG. 3, in which position the transmitting element protrudes into the key-slot and obstructs movement of the end portion 22 of the key out of the key-slot. Thus, the key is maintained captive in the member 11 until that member is turned about the axis 17 to a position where the locking element 14 is aligned with the opening in the housing 10 which contains the solenoid 18 or a similar opening. Generally, only one such opening will be provided so that the key can be withdrawn only when the member 11 occupies a predetermined rotational position relative to the housing 10.

When provided, the tumblers 13 maintain the key-receiving member 11 in such a position relative to the housing 10 that the locking element 14 is properly aligned with the openings in the housing 10 and key-receiving member 11 until the key is fully inserted into the key-slot. Whilst properly aligned with these openings, the locking element can move between its locking and releasing positions without binding. Reading of information from the key is preferably completed before insertion of the key is fully completed, so that the solenoid can be energised just before movement of the tumblers 13 into their respective releasing positions is completed. In this way, the tumblers prevent binding of the locking element before that element has reached its releasing position. A releasable detent may be provided in addition to or in place of the tumblers 13 for inhibiting rotation of the key-receiving member 11 relative to the housing 10 until the locking element 14 has reached its releasing position. Such detent may comprise a spring-loaded ball guided for movement in a bore of the housing 10 and engageable in a complementary recess in the key-receiving member 11. The pin 26 and lever 27 are preferably so arranged that they do not obstruct rotation of the member 11 relative to the housing either when the key is fully inserted or when the key is absent from the key-slot.

Figure 4:
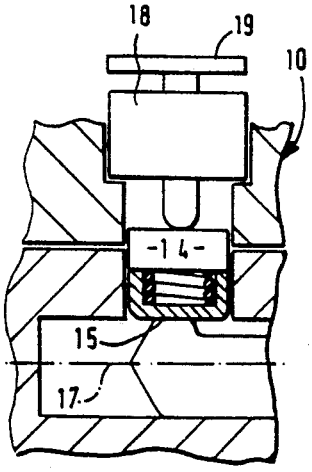

The key-receiving member 11 may be used for transmitting torque from the key 12 to a bolt or other associated device or for controlling operation of an associated device in a known manner. After operation, the key-receiving member 11 is turned back to its initial position relative to the housing 10, bringing the locking element 14 into alignment with the opening in the housing 10 which contains the solenoid 18. Once such alignment has been achieved, the key can be withdrawn from the keyslot because the transmitting element 15 and the locking element 14 are free to move, under the action of pressure exerted by the end portion 22 of the key, away from the key slot, as shown in FIG. 4. The transmitting element ensures that the locking element is driven positively into its locking position during withdrawal of the key. The spring 16 exerts only a small force to ensure that the locking element does not return to its releasing position under the direction of gravity on the locking element and the armature 19. During movement of the locking element from its releasing position to its locking position, the armature is moved away from the pole piece of the solenoid and is returned to the position illustrated in FIGS. 2 and 3.

The tumblers 13 lie at respective positions along the axis 17 which are between the position occupied by the locking element 14 and the position of the follower 26. A further tumbler, 31 occupies a position spaced from the tumblers 13 along the axis 17 beyond the locking element 14. When the key has been inserted into the key-receiving member 11, the leading end portion 22 of the key engages the tumbler 31 and so positions that tumbler that it no longer restrains rotation of the key-receiving member relative to the housing 10. In the absence of the key, a part of the tumbler 31 lies partly in the key-receiving member and partly in the housing to prevent relative rotation, in the usual manner. Furthermore, if there is applied to the lock a key having a leading end portion which has the same width as does an intermediate portion of the key, then such leading end portion of the key is sufficiently wide to position the tumbler 31 in the releasing position, then it also sufficiently wide to ensure that the locking element 14 is moved into the locking position, when the key is withdrawn. The tumbler 31 may be provided in a case where the tumblers 13 are omitted.

Whilst, for convenience of illustration, reading means for reading information from a single row of openings in the key has been illustrated, the key would normally be formed with at least two rows of openings, for example two rows of recesses, the recesses of one row opening at one side of the key and the recesses of the other row opening at the other side of the key. Alternatively, the key could be formed with two rows of apertures, the rows being offset from one another laterally with respect to the key. For each row of openings in the key, there would be provided in the lock a respective follower pin, lever, emitter and detector. One row of openings in the key may constitute a clocktrack, which determines the times at which the or each other row of openings will be interrogated by the electronic processor.

The pin 26 of the reading means is preferably so arranged that, in the absence of the key, it lies partly in the member 11 and partly in the housing 10, thereby restraining rotation of the member 11. When the key has been fully inserted, the pin comes to rest in a position in which it lies entirely within the member 11 and does not then obstruct rotation. Alternatively, the pin 26 may be divided into two parts, namely a part which lies nearer to the axis 17 and always lies entirely within the member 11 and an outer part which, when the key is absent, lies partly in the member 11 and partly in the housing 10 and, when the key has been inserted, lies entirely in the housing 10. It will be noted that the lever 27 must be moved, in order to release the member 11 for rotation relative to the housing. This initial movement of the lever may be used to provide a signal which alerts the electronic processor. The processor may be arranged to provide an alarm signal unless the proper key is read within a predetermined period following initial movement of the pin 26 and lever 27. Such alarm signal may ensure that the lock remains in a secure condition for a predetermined period and/or energise a remote alarm device.

By way of example, two only tumblers 13 have been shown in the drawings but normally a larger number of tumblers would be provided for operation by the key.

The lock illustrated in FIGS. 1 to 4 has a microprocessor connected electrically with the reading means of the lock. Also connected with the microprocessor is a switch for providing an entry signal when a key is first introduced into the key slot. Such switch may be associated with a shutter which normally closes the keyslot. Operation of this switch when insertion of a key is connected instructs the microprocessor to become active and to energise intermittently the diode corresponding to that follower which is aligned with the clocktrack of the key. When the leading end of the key reaches this follower, the follower is moved and an appropriate signal is provided to the microprocessor. If that follower does not move into a recess of the clocktrack within a predetermined period, for example 2.5 seconds, then the microprocessor assumes a default condition and energisation of the solenoid or other motor is prevented.

Figure 5:
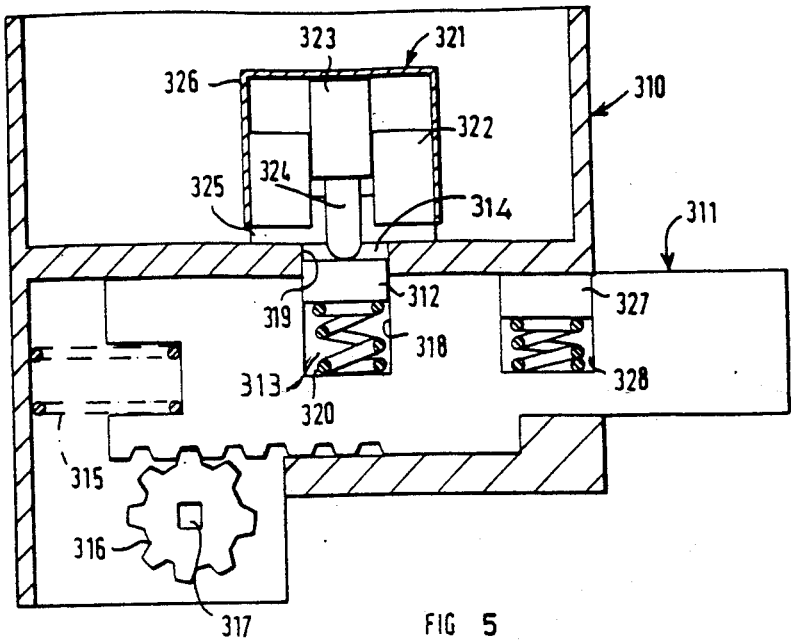
FIG. 5 shows a diagrammatic representation of a cross-section through a latch in a locked condition.
Figure 6:
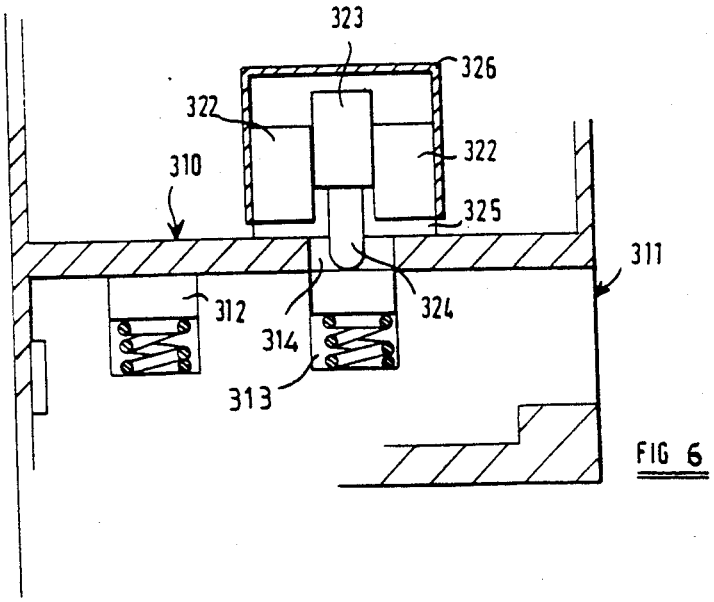
FIG. 6 illustrates the unlocked condition of the latch of FIG. 5.

The security device illustrated in FIGS. 5 and 6 is a latch comprising a hollow body 310 and a bolt 311 mounted in the body for movement between a projected position shown in FIG. 5, in which an end portion of the bolt protrudes from the body and a retracted position in which the bolt lies entirely within the body. The latch may be fitted in a door in a known manner for co-operation with a keeper to hold the door closed until an appropriate signal is provided to the latch.

For holding the bolt in the projected position, there is provided an obstructing element 312 which is engageable with both the body 310 and the bolt 311 and which is movable between the obstructing position illustrated in FIG. 5, in which the element 312 lies partly in an opening 313 in the bolt 311 and partly in an opening 314 in the body 310, and the releasing position illustrated in FIG. 6, in which the obstructing element lies entirely within the opening 313 of the bolt.

For moving the bolt from the retracted position to the projected position, there is provided a coiled compression spring 315 which acts between the body and the bolt. For moving the bolt from the projected position to the retracted position, when the obstructing element 312 occupies its releasing position, there is provided transmission means for transmitting movement from a handle (not shown) to the bolt. The transmission means illustrated comprises a pinion 316 which is enmeshed with a rack formed on the bolt and a shaft 317 which couples the pinion with the handle.

If an attempt is made to move the bolt from the projected position to the retracted position whilst the obstructing element is in the obstructing position, an abutment face 318 on the bolt, which forms a part of the boundary of the opening 313, bears against the element 312 under pressure and the obstructing element bears under pressure against an abutment face 319 on the body which forms a part of the boundary of the opening 314. The faces 318 and 319 face generally towards each other and whilst the abutment element is interposed between them, it prevents movement of these faces towards each other and so obstructs movement of the bolt to the retracted position. In its obstructing position, the obstructing element is in overlapping relation with both of the faces 318 and 319. In its releasing position, shown in FIG. 6, the obstructing element is out of overlapping relation with the face 319 but remains in overlapping relation with the face 318. However, the obstructing element is then free to participate in movement of the bolt 311 relative to the body 310.

A spring 320 is provided in the opening 313 to act between the bolt 311 and the obstructing element 312 and urge the obstructing element towards its obstructing position. For driving the obstructing element from the obstructing position to the releasing position, there is provided electrically energisable driving means 321 which is mounted in the body 310 adjacent to the opening 314. The particular example of driving means illustrated in the accompanying drawing has the form of a solenoid comprising an annular winding 322 and an armature 323 formed of a material having a high magnetic permeability. For transmitting motion from the armature to the obstructing element 312, there is provided an elongated transmitting element 324 of substantially non-magnetic material. The driving means further comprises a guide element 325 which guides the transmitting element 324 for reciprocation along a path which passes centrally through the opening 314.

The transmitting element 324 is normally maintained in contact with both the armature 323 and the obstructing element 312 by the action of the spring 320. Movement of these components in a direction away from the opening 313 in the bolt is limited by a casing 326 of the driving means. Movement of the armature in the opposite direction is limited by engagement of an end face of the armature with the guide element 325. As shown in FIG. 5, when the obstructing element 312 occupies its obstructing position, the armature 323 lies partly inside and partly outside the winding 322. When the latter is energised by passing an electric current through the winding, the armature is drawn into the winding to abut the guide element 325 and displace the obstructing element to its releasing position shown in FIG. 2. The solenoid and the guide element 325 are fixed with respect to the body 310. It will be noted that, when the armature abuts the guide element 325, the transmitting element 324 does not protrude into the opening 313 of the bolt. Thus, the driving means does not impede movement of the bolt and obstructing element relative to the body. When the bolt is in its retracted position, the obstructing element bears against an internal face of the body 310 and is held by that face in its releasing position. Energisation of the driving means 321 can be terminated, once the bolt has been moved a part of the way from the projected position to the retracted position, without further movement being obstructed.

The body 310 and bolt 311 are provided with co-operating abutments for limiting travel of the bolt relative to the body in a direction from the retracted position to the projected position, so that the bolt cannot move beyond that position in which the opening 313 is aligned with the opening 314. To facilitate movement of the obstructing element 312 into the opening 314, the entrance to that opening may be flared. Alternatively, the diameter of the opening 314 may be somewhat greater than the diameter of the opening 313 and of the obstructing element 312. It is preferred that the obstructing element is a free-sliding fit in the opening 313, in order that the bolt can guide the obstructing element. Whilst both of the openings 313 and 314 are preferably circular, as viewed in plan, it will be understood that it is not essential for these openings to have the same shape. The shape of the opening 313 preferably compliments that of the element 312. The shape of the opening 314 may be quite different, for example an elongated slot.

Optionally, there may be provided a further obstructing element 327 mounted in a further recess 328 provided in the bolt 311 at a position spaced along the bolt from the recess 313. The recess 328 may be aligned with the opening 314, when the bolt is in the retracted position. With this arrangement, energisation of the solenoid is required to release the bolt for movement from its projected position and also to release the bolt for movement from its retracted position. However, energisation for only a very brief period is necessary if the solenoid is adapted to latch the transmission element 324 in the position illustrated in FIG. 6. The guide element 325 may be formed of mild steel or other magnetic material so that residual magnetism will hold the armature 323 in the position shown in FIG. 6 after energisation of the solenoid has been terminated.

It will be understood that, as an alternative to the provision of two obstructing elements in the bolt, there may be mounted on the body 310 two solenoids for co-operation with a single obstructing element mounted in the bolt, when the bolt is in respective different positions.

The arrangement of obstructing element and driving means illustrated in the accompanying drawing may be used to control relative movement of members which is other than reciprocation. For example, the opening 313 may be formed in a cylindrical dey-receiving member of a lock, the opening 314 being formed in a housing of that member. With this arrangement, the key-receiving member would be rotatable relative to the housing when the obstructing element is in the releasing position but relative rotation would be obstructed by the obstructing element in its obstructing position. In a case where the obstructing element is required to control relative rotation of two members, the obstructing element may be received in an opening in a peripheral face of one of the members or in an opening in a face of the member which is presented in a direction along the axis of rotation. The device illustrated in the accompanying drawing may be further modified by substitution for the solenoid of some other form of electrically energisable motor, for example a rotary motor having transmission means for converting rotary movement to reciprocation. The motor may be a piezo electric device having transmission means for amplifying the motion which is imparted to the obstructing element.

Whilst it is convenient to mount the driving means in a stationary member or in a member which is fixed with respect to a larger structure in which the device is mounted, it will be understood that the driving means could be mounted in the bolt 311 to reciprocate relative to the body with the bolt, in which case the obstructing element 312 would remain stationary with the body 310 when the bolt is reciprocated.

Figure 7:
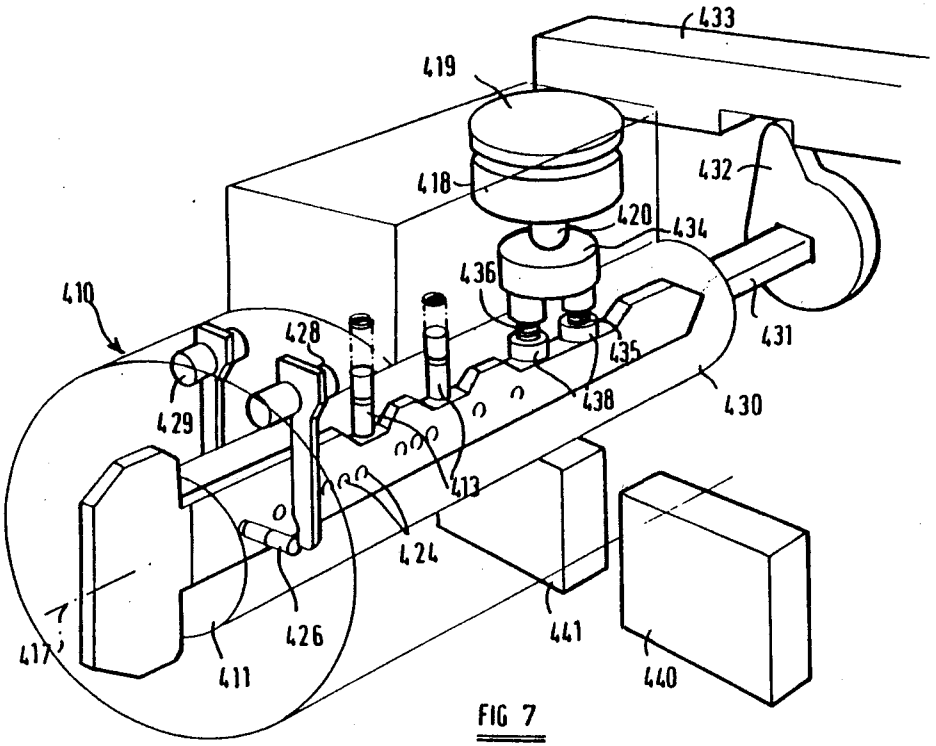
FIG. 7 is a diagrammatic representation of a perspective view of a further lock and key.

The security device illustrated in FIG. 7 comprises certain parts which correspond to parts hereinbefore described, with references to FIGS. 1 to 4. In FIG. 7, such corresponding parts are identified by like reference numerals with the prefix 4 and the preceding description is deemed to apply, except for the differences hereinafter mentioned.

The security device of FIG. 7 includes a cylinder lock mechanism comprising a housing 410 containing a key-receiving member 411 arranged for rotation relative to the housing about an axis 417 and, in the absence of the key, restrained against rotation by tumblers 413 and by pins 426 of reading means. There is also disposed in the housing 410, in co-axial relation with the key-receiving member 411, a driving member 430 which is also rotatable about the axis 417. The driving member is connected by an output shaft 431 with a cam 432 for moving a bolt 433 between a projected position and a retracted position.

If required, the numbers 413 may be omitted and the pins 426 of the reading means may be so arranged that the key-receiving member 411 is freely rotatable relative to the body 410 in the absence of the proper key. The key-receiving member receives the key with a sliding fit and that part of the key which enters the member 411 has a non-circular transverse cross-section, so that it is adapted to transmit torque to the member 411. The driving member 430 receives an end portion of the key with substantial clearance, so that the key is unable to engage the member 430 and transmit torque thereto directly.

A clutch is provided for transmitting drive from the member 411 to the member 430. The clutch comprises an obstructing element 434 which, when the key is absent, is disposed entirely in a recess formed in an internal surface of the housing 410 adjacent to the members 411 and 430. The latter members are formed with respective recesses which can collectively receive the obstructing element 434, provided these recesses are aligned with the recess in the housing 410.

The obstructing element 434 is urged into the recess in the housing 410 by a pair of springs 435 and 436 disposed respectively in the recesses provided in the members 411 and 430. End portions of these springs nearer to the axis 417 bear against respective transmitting elements 437, 438, each of which is arranged in substantially the same manner as is the transmitting element 15 hereinbefore described. Opposite end portions of the springs are covered by respective caps. These caps bear against the obstructing element 434.

For moving the obstructing element 434 into the recesses of the members 411 and 430, to establish the driving condition of the clutch, there is mounted in the body 410 a solenoid arrangement which is substantially the same as that provided in the lock of FIG. 1.

The device of FIG. 7 may be modified by the provision on the obstructing element 434 of a projection which, when that element is outside the recess in the key-receiving member 411, projects into the recess of the driving member 430. With this modification, when the clutch is in a non-driving condition, rotation of the member 430 relative to the housing 410 is prevented by the obstructing element.

The transmitting elements 438 and 437 are arranged to retain the key in the cylinder lock mechanism until the obstructing element 434 lies in the recess in the housing 410. It will be understood that the obstructing element can move into this recess only after alignment of the recesses in the members 411 and 430 with the recess in the housing 410 has been established. The housing 410 may be formed to obstruct insertion of the key into the member 411, unless the latter is in a position such that the recess defined by the member 411 is aligned with the obstructing element 434.

When the key is absent from the security device of FIG. 7, the clutch is in the non-driving condition. During insertion of the key, data represented by one or more rows of depressions 424 in the key is read by the reading means and is applied to a microprocessor 440 which compares the data read from the key with the data stored in the memory of the micro-processor. If the data read from the key is found to be acceptable, the microprocessor provides an output signal which causes electrical power to be applied from a battery 441 to the solenoid 418. The solenoid is energised for a brief period, for example 50 milliseconds. This is sufficient to set the clutch in the driving condition. The driving condition is maintained by residual magnetism, which holds the armature 419 in engagement with the pole piece of the solenoid. The key can then be turned, so that drive will be transmitted from a user via the key, the key-receiving member 411, the obstructing element 434, the driving member 430 and the cam 432 to the bolt 433. When the key is turned, the obstructing element 434 is carried with the key-receiving member 411 away from the recess defined by the housing 410. The obstructing element bears against an internal surface of the housing so that it is confined to the recesses defined by the members 411 and 430. After the bolt has been moved to the retracted position, rotation of the key can be reversed to return the obstructing element 434 to the position in which it is aligned with the recess defined by the housing. If the key is then withdrawn, the transmission elements 435 and 436 drive the obstructing element, output element 420 and armature 419 away from the axis 417 so that the non-driving condition of the clutch is re-established. The non-driving condition will then be retained indefinitely by the springs 435 and 436 until the solenoid is energised once more.

As an alternative to arrangement of the solenoid for latching of the armature by magnetic forces, the output element of the solenoid and the obstructing element may be latched in a position to which they have been set by a mechanical latch, as disclosed in GB No. 2,166,484 to be published on 8th May 1986. There may be associated with such a mechanical latch two solenoids, a respective one for setting the obstructing element in each of the alternative positions. In a further alternative arrangement, the armature may be a permanent magnet and the microprocessor may be arranged for changing the polarity of the solenoid to drive the armature in a selected direction. The armature may be coupled with the obstructing element by coupling means which enables the armature to push and to pull the obstructing element. Furthermore, two obstructing elements may be provided, one resting on the other and these being movable so that either obstructing element can be positioned to restrain relative movement of two members and that both obstructing elements can be positioned to permit relative movement of those members.

Figure 9:
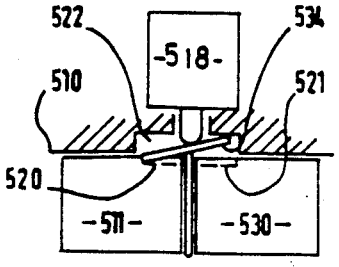
FIG. 9 illustrates a further modification of the lock of FIG. 7.
Figure 11:
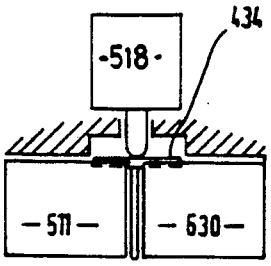
FIG. 11 is a diagrammatic representation similar to FIG. 9 but illustrating the lock of FIGS. 9 and 10 in a different condition.
Figure 10:
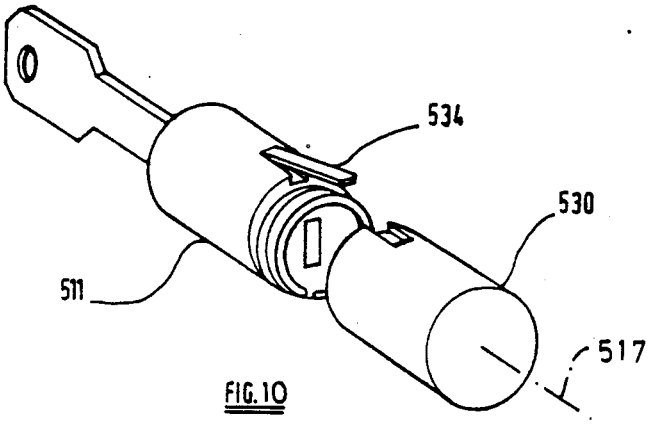
FIG. 10 illustrates the modification of FIG. 9 by a perspective view, certain components of the lock being separated from one another for clarity of illustration.
Figure 8:
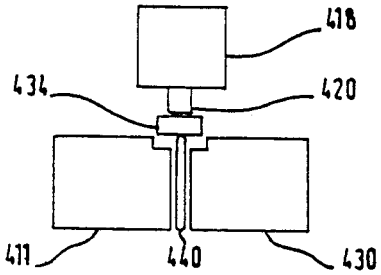
FIG. 8 is a diagram illustrating a modification of the lock of FIG. 7.

In FIGS. 9 to 11, there is illustrated a modification of the lock of FIG. 7 with a pair of members, 511 and 530 arranged end-to-end in a housing 510 for rotation relative to the housing about a common axis 517. An obstructing element 534 is mounted in a recess 520 in the member 511 for movement into a position shown in FIG. 9, in which the obstructing element lies partly in a recess 520 of the member 511 and partly in a recess 522 of the member 510 but lies entirely outside the member 530. With the obstructing element in this position, turning of the member 530 relative to the members 510 and 511 is not restrained but turning of the member 511 about the axis 517 relative to the housing is restrained. By means of a solenoid or other electrically energisable device 518 mounted in the housing 510, the obstructing element can be moved into the position shown in FIG. 16, where it lies partly in the recess 520 and partly in a recess 521 in the member 530 but lies entirely outside the recess 522 in the housing. In this position, the obstructing element prevents relative rotation of the members 511 and 530 but permits these members to move together relative to the housing 510. Either one of the members 511 and 530 may be a key-receiving member and the other may be a driving member adapted to transmit drive to an associated device.

The obstructing element 534 may be rectangular and pivoted adjacent to one of its ends to the member 511 for movement relative thereto about a pivot axis which is transverse to the axis 517. A leaf spring may be arranged to act between the member 511 and the obstructing element, to urge the obstructing element to the position shown in FIG. 9. Whilst in other figures of the drawings enclosed herewith, a cylindrical obstructing element has been illustrated, it will be understood that obstructing elements of other shapes, for example square, may be provided.

In each of the locks hereinbefore described, movement of the contact element in a direction towards the axis of rotation of the key-receiving member may be limited by the key-receiving member itself, rather than by the key, so that the contact element can protrude into an opening in the key without touching the boundary of that opening when the opening is fully aligned with the contact element.

The microprocessor of each lock may be arranged to maintain the obstructing element associated with the solenoid in a secure condition when the key is absent. Alternatively, the microprocessor may be arranged to maintain the obstructing element in an insecure condition when the key is absent and to establish the secure condition of the obstructing element when there is introduced into the key-receiving member a key from which the reading means does not read acceptable data within a predetermined period. In the event of the reading means failing to read acceptable data, for example because an unauthorized key has been applied, the microprocessor would establish the secure condition. As noted above, tumblers may be used to establish a secure condition independently of the microprocessor or reliance may be placed entirely on the electrically controlled obstructing element to establish the secure condition of the device.

The microprocessor of each lock may be adapted to accept respective different data from different keys so that the different keys can be used in succession to operate the lock.

Further details of the arrangements herein described are disclosed in WO87/02735, from which the present application is divided.

We claim:

1. A lock comprising two relatively movable members, relative movement of which is required to be restrained, and control means for selectively obstructing relative movement of said members, wherein the control means includes an obstructing element, guide means for guiding the obstructing element for movement between an obstructing position in which the obstructing element engages a first of said members to obstruct said relative movement and a releasing position in which the obstructing element does not so engage said first of the members, and an electrically energisable electromagnetic device for moving the obstructing element between said obstructing and releasing positions, wherein said device has a pole piece in which magnetism is induced by energisation of the device, in which a residual part of said magnetism is retained when the device is de-energised and which, when energisation of said device is terminated, retains the obstructing element by magnetic attraction in a position to which the obstructing element has been set by energisation of the device.

* * * * *

UNITED STATES PATENT AND TRADEMARK OFFICE

CERTIFICATE OF CORRECTION

PATENT NO. : 4,916,927

DATED : April 17, 1990

INVENTOR(S) : JOHN O'CONNELL ET AL.

It is certified that error appears in the above-identified patent and that said Letters Patent is hereby corrected as shown below:

On the title page Item [73] should read

Assignee: Lowe & Fletcher Limited, West Midlands, England.

Signed and Sealed this

Twenty-fourth Day of September, 1991

*Attest:*

HARRY F. MANBECK, JR.

*Attesting Officer*

*Commissioner of Patents and Trademarks*